US007992354B2

(12) United States Patent
Doda, Jr.

(10) Patent No.: US 7,992,354 B2
(45) Date of Patent: Aug. 9, 2011

(54) DEVICE FOR LEVELING AND ALIGNING TILES AND METHOD FOR LEVELING AND ALIGNING TILES

(75) Inventor: Robert C. Doda, Jr., Pompano Beach, FL (US)

(73) Assignee: Q.E.P. Co., Inc., Boca Raton, FL (US)

( * ) Notice: Subject to any disclaimer, the term of this patent is extended or adjusted under 35 U.S.C. 154(b) by 182 days.

(21) Appl. No.: 12/079,175

(22) Filed: Mar. 24, 2008

(65) Prior Publication Data

US 2008/0236094 A1 Oct. 2, 2008

Related U.S. Application Data

(60) Provisional application No. 60/920,430, filed on Mar. 26, 2007.

(51) Int. Cl.
*E04F 21/20* (2006.01)

(52) U.S. Cl. ..... 52/127.7; 52/749.11; 52/747.11

(58) Field of Classification Search ..... 52/127.3, 52/127.7, 98, 100, 389, 384, 385, 388, 749.1, 52/749.11, 749.15, 506.7; 33/526
See application file for complete search history.

(56) References Cited

U.S. PATENT DOCUMENTS

| | | | | |
|---|---|---|---|---|
| 2,080,190 | A * | 5/1937 | Sinner | 52/698 |
| 2,769,212 | A * | 11/1956 | Hammitt et al. | 52/750 |
| 3,234,692 | A * | 2/1966 | Knud | 52/392 |
| 4,397,125 | A * | 8/1983 | Gussler, Jr. | 52/127.3 |
| 4,503,654 | A * | 3/1985 | Cosentino | 52/747.11 |
| 4,953,341 | A * | 9/1990 | Joos | 52/747.11 |
| 5,535,566 | A * | 7/1996 | Wilson et al. | 52/506.07 |
| 5,623,799 | A * | 4/1997 | Kowalski et al. | 52/392 |
| 5,675,942 | A * | 10/1997 | Crawford | 52/127.3 |
| 6,245,415 | B1 * | 6/2001 | Keller et al. | 428/188 |
| 6,739,673 | B2 * | 5/2004 | Gupta et al. | 297/452.65 |
| 7,128,373 | B2 * | 10/2006 | Kurtycz et al. | 297/452.15 |
| 7,516,558 | B2 * | 4/2009 | Frank et al. | 33/526 |
| 7,603,825 | B2 * | 10/2009 | Dohren | 52/478 |
| 7,621,100 | B2 * | 11/2009 | Kufner et al. | 52/749.11 |
| 7,861,487 | B2 * | 1/2011 | Kufner et al. | 52/749.11 |
| 2001/0020350 | A1 * | 9/2001 | Gorman | 52/210 |
| 2005/0260385 | A1 * | 11/2005 | Cowelchuk et al. | 428/138 |
| 2005/0269837 | A1 * | 12/2005 | Carroll et al. | 296/187.03 |
| 2006/0185319 | A1 * | 8/2006 | Kufner et al. | 52/749.11 |

FOREIGN PATENT DOCUMENTS

| | | |
|---|---|---|
| IT | MO2002A000035 | 8/2003 |
| WO | WO 92/14012 | 8/1992 |
| WO | WO 2006/091606 A2 | 8/2006 |

OTHER PUBLICATIONS

International Search Report dated Jul. 16, 2008 for International Application No. PCT/US2008/003868.

Edward, Charles, Certified English Language Translation of Italian Patent Publication No. ITMO2002A000035, published Aug. 16, 2003; dated Mar. 23, 2011; 18 Pages.

* cited by examiner

*Primary Examiner* — David Dunn
*Assistant Examiner* — Alp Akbasli
(74) *Attorney, Agent, or Firm* — Christie, Parker & Hale, LLP

(57) ABSTRACT

A tile leveling device is provided. The device includes a main member, a first section extending transversely from the main member for receiving a first tile and a second section extending transversely from the main member in a direction opposite the first section for receiving a second tile. A member is provided for penetrating the main member and exerting a force on the tiles for leveling them relative to each other. A method for leveling tiles is also provided.

10 Claims, 6 Drawing Sheets

DEVICE FOR LEVELING AND ALIGNING TILES AND METHOD FOR LEVELING AND ALIGNING TILES

CROSS-REFERENCE TO RELATED APPLICATION

This application is based upon and claims priority on U.S. Provisional Application No. 60/920,430, filed on Mar. 26, 2007, the contents of which are fully incorporated herein by reference.

BACKGROUND OF THE INVENTION

This invention relates to a device for leveling, aligning and properly spacing tiles. Tiles are usually laid on a substrate or subsurface such a floor or other flat surface adjacent to each other and spaced apart from each other by a small gap. Typically an adhesive is troweled on the surface where the tile is to be applied. Adhesive may also be applied to the back side of the tile. The tile is then placed and adhered to the subsurface. Another tile is then adhered to the subsurface in the same manner next to the previous tile. Typically, spacers may be used to evenly space one tile from the other. However, depending on the unevenness of the subsurface e, i.e., floor, on which the tiles are applied and the unevenness of the applied adhesive, adjacent tiles are not always aligned and thus are not level relative to each other. In this regard, an edge of one tile may extend beyond an edge of an adjacent tile. To overcome this problem, a leveling device has been created which includes a leveling member 10 and a wedge 12, as for example shown in FIG. 1. The leveling member has a vertically aligned member 14 and a generally horizontally curving member 16 (the "horizontal member"), as shown in FIG. 1. The vertical member extends from the horizontal member. A breakaway line 22 is defined on the vertical member on either surface thereof proximate the horizontal member. The breakaway line is defined by removing material from either surface of the vertical member such that the thickness of the vertical member along the line is reduced and the vertical member is weaker along such line.

The device is placed such that one end of the tile sits on one end of the horizontal member of the device and abuts one surface of the vertical member of the device and an adjacent tile sits on the other end of the horizontal member and abuts an opposite surface of the vertical member, as for example shown in FIGS. 2 and 3. The wedge member is then pushed through opening 20. As the wedge is continually pushed through opening 20 due to its increasing thickness, it causes the edge of each tile to be compressed downward pressing the horizontal member beneath it toward the subsurface. As a result the tiles are aligned and leveled, as shown in FIG. 4. The spacing between the tiles is controlled by the thickness of the vertical member. Once the tiles set, the vertical member along with the wedge is broken off by kicking or applying a force on the vertical member such that it breaks along the weaker breakaway line 22. As can be seen in FIG. 5, the breakaway line is positioned such that it is flush with the undersurface of the tiles when the tiles are adhered to the floor. The problem with this device is that at times, adhesive fills out the breakaway line. In this regard, it is very difficult to break off the vertical member from the horizontal member due to the adhesive on the breakaway line. Moreover, adhesive at times may not extend over the horizontal member. Consequently, the ends of the portions of the tile which extend over the horizontal member are not adhered to the undersurface or to the horizontal member which may have adhered to the undersurface. As such, these non-adhered ends of the tiles are susceptible to cracking, as they are not properly supported. Consequently, a leveling, aligning and spacing device is required that overcomes the problems of the prior art.

SUMMARY OF THE INVENTION

In an exemplary embodiment a tile leveling device and tile combination is provided. The combination includes a first tile having a first surface opposite a second surface, a second tile having a first surface opposite a second surface and a device having a main member, a first section extending transversely from the main member and a second section a second section extending transversely from the main member in a direction opposite the first section. The first tile is located over the first section and the second tile is located over the second section. An opening is formed through the main member and a member is provided for penetrating the opening and exerting a force against both tiles pressing the tiles against the first and second sections. A breakaway section is defined along the main member. The breakaway section is located between the first and second surfaces of each of the first and second tiles. In another exemplary embodiment, an opening is formed through the first section for allowing an adhesive to flow there through. In a further exemplary embodiment, an opening is formed through the second section for allowing an adhesive to flow there through. In another exemplary embodiment, the opening formed through the main member includes a first edge opposite a second edge such that the first edge is further from the first and second sections than the second edge. A stiffener portion is formed proximate the first edge for bolstering the first edge. In yet another exemplary embodiment, the main member includes a first notch extending from a first edge of the main member and a second notch extending from a second edge of the main member and the breakaway section extends from the first notch to the second notch. In yet a further exemplary embodiment, each of the first and second sections have at least a curved portion having a curvature when viewed in cross-section, such that the force causes this curvature to reduce.

In another exemplary embodiment a tile leveling device is provided including a main member, a first section extending transversely from the main member for receiving a first tile having a first surface opposite a second surface, and a second section extending transversely from said main member in a direction opposite the first section for receiving a second tile having a first surface opposite a second surface. A first opening is formed thought the first section. A second opening formed thought the second section. A third opening formed though the main member. In yet another exemplary embodiment, the opening formed through the main member includes a first edge opposite a second edge such that the first edge is further from the first and second sections than the second edge. A stiffener portion is formed proximate the first edge for bolstering the first edge. In yet a further exemplary embodiment, the device further includes a reduced thickness breakaway section formed on the main member. The main member is also includes a first notch extending from a first edge of the main member and a second notch extending from a second edge of the main member and the breakaway section extends from the first notch to the second notch.

In a further exemplary embodiment, a method for leveling tiles is provided. The method includes providing a tile leveling device which includes a main member, a first section extending transversely from the main member and having a first opening formed there through, a second section extending transversely from the main member in a direction opposite the first section and having a second opening formed there through. A third opening is formed through the main member, and a breakaway section is defined along the main member. The method further includes placing the leveling device over a subsurface, placing a first tile over the first section, where the tile has a first surface opposite a second surface, and the second surface if farther from the first section than said first surface, and placing a second tile over said second section, where the second tile has a first surface opposite a second surface and the second tile second surface if farther from the second section than said second tile first surface. The method further includes applying a first adhesive between the first tile and the subsurface, applying a second adhesive between the second tile and the subsurface, and placing a member through the third opening such that the member exerts a force on the first and second tiles pressing the tiles against the first and second sections leveling the first tile second surface relative to the second tile second surface whereby the first adhesive penetrates the first opening and contacts the first tile first surface and the subsurface, and the second adhesive penetrates the second opening and contacts the second tile first surface and the subsurface, and causing the breakaway section to be located between the first and second surfaces of each tile. The method also includes curing the adhesives for adhering the tiles relative to the subsurface and breaking the main member along the breakaway section. In another exemplary embodiment, the second adhesive is the same as the first adhesive. In yet a further exemplary embodiment, the tiles are abutted against said main member prior to curing.

DETAILED DESCRIPTION OF THE INVENTION

Figure 1:
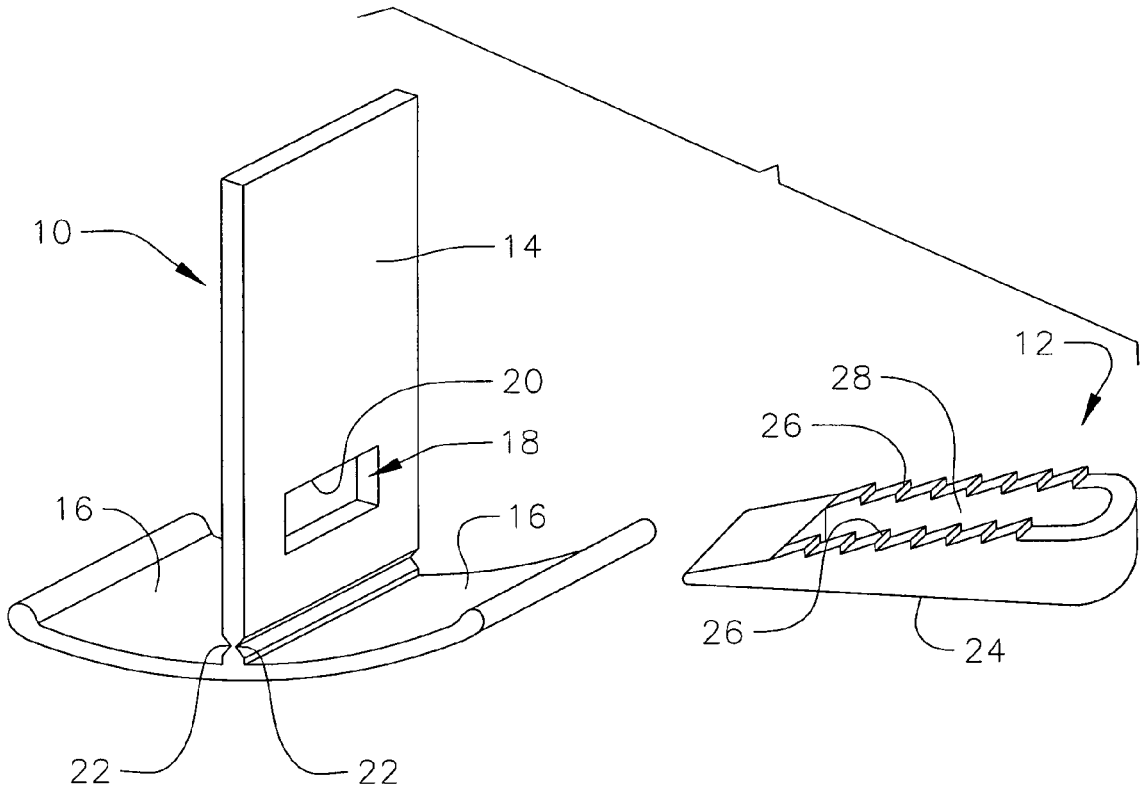
FIG. 1 is a perspective view of a prior art leveling and spacing device.
Figure 2:
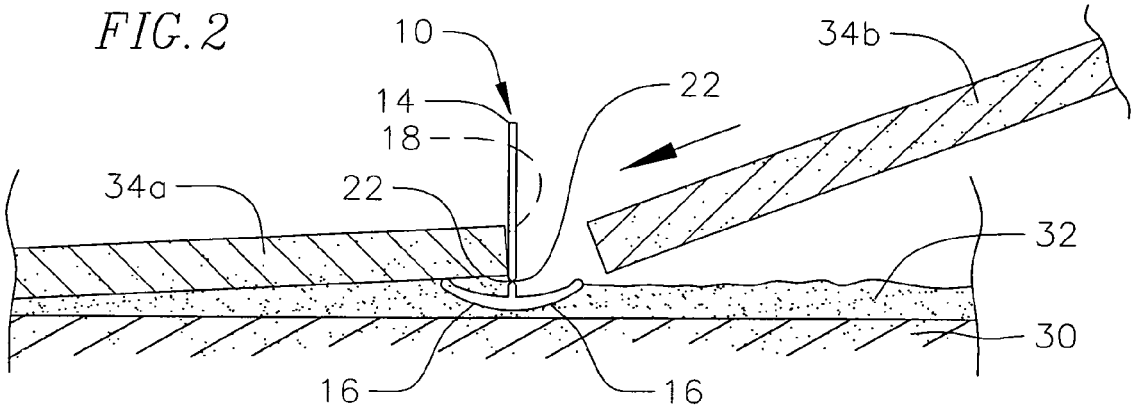
FIGS. 2, 3, 4 and 5 are cross-sectional views showing use of the prior art leveling device.
Figure 3:
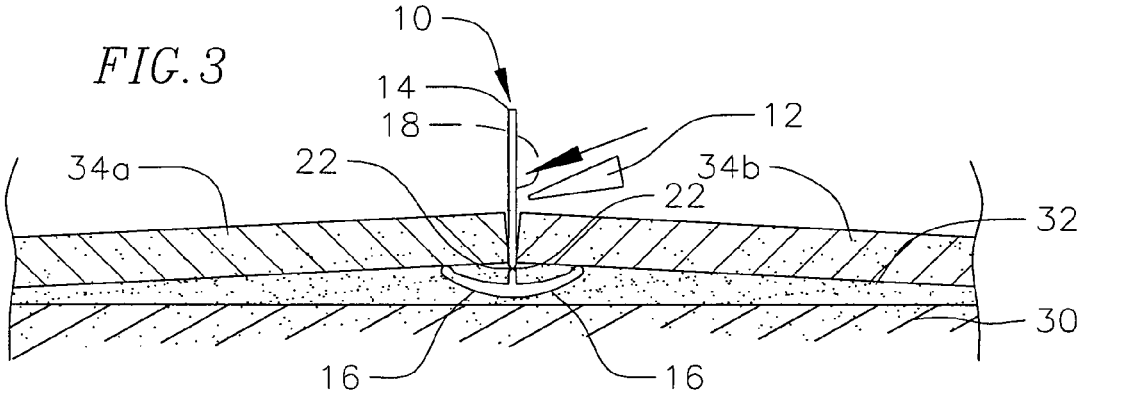
Figure 4:
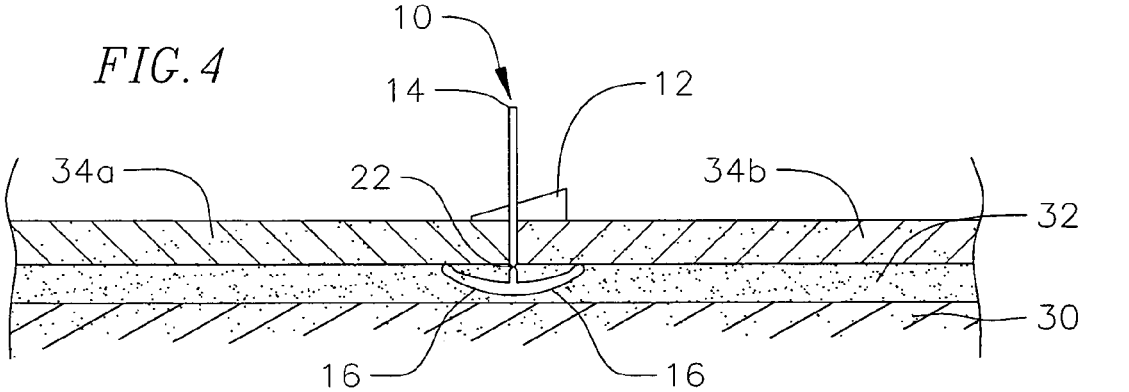
Figure 5:
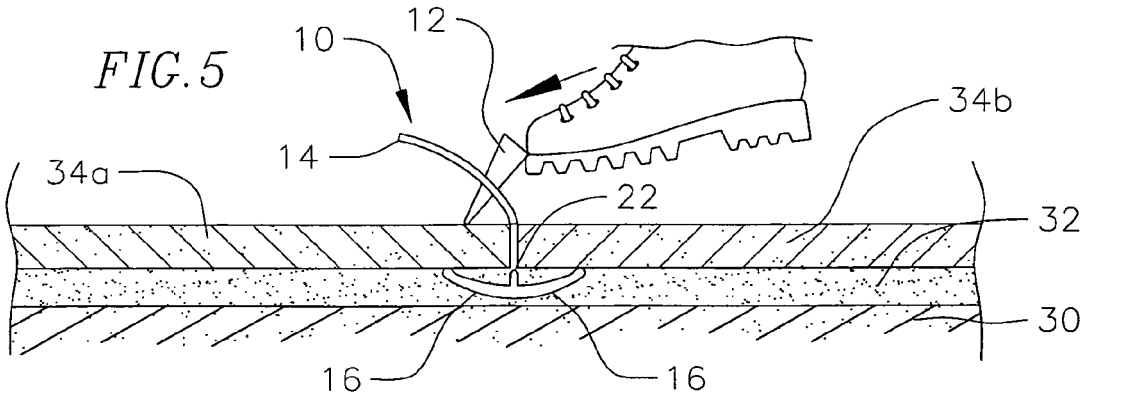
Figure 6:
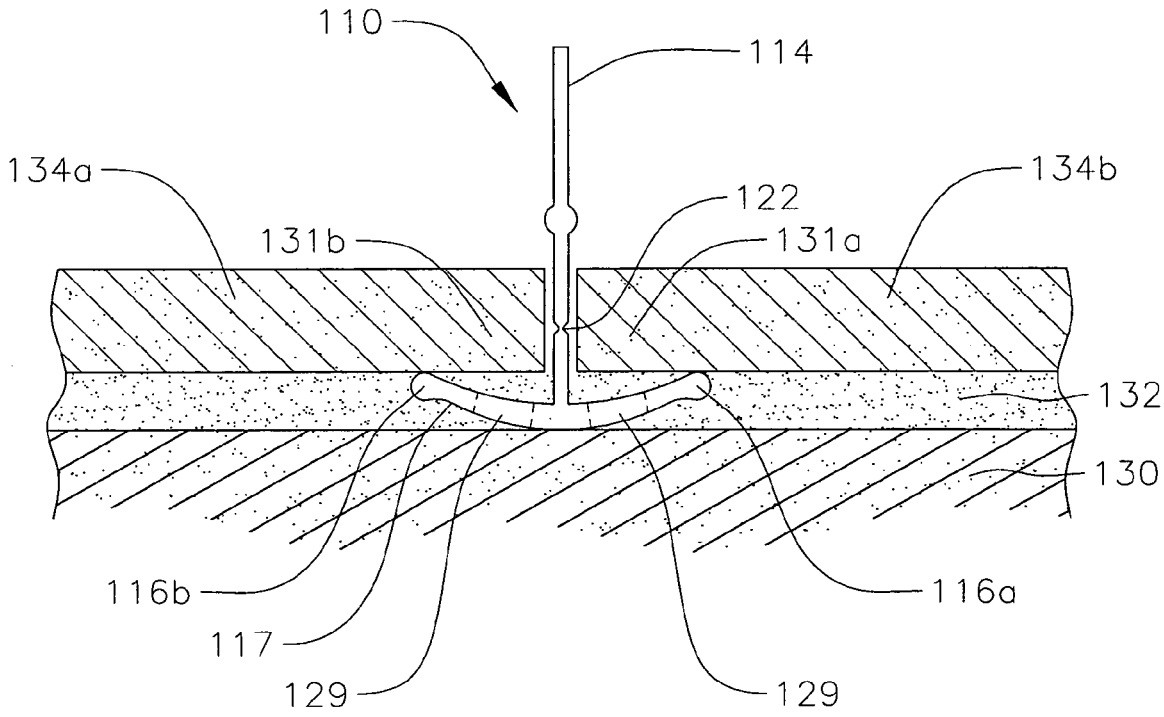
FIG. 6 is a cross-sectional view of an exemplary embodiment leveling and spacing device of the present invention installed.
Figure 7:
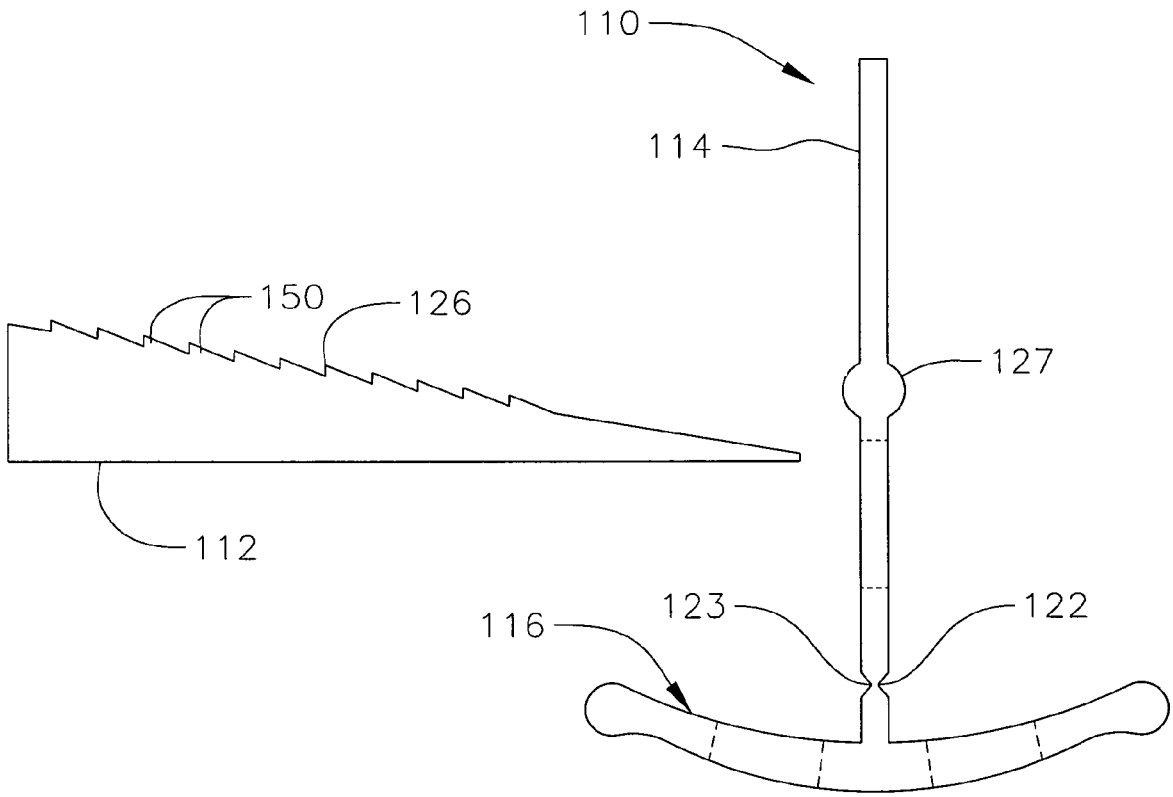
FIG. 7 is an end view of an exemplary embodiment leveling device, including an exemplary embodiment wedge.
Figure 8:
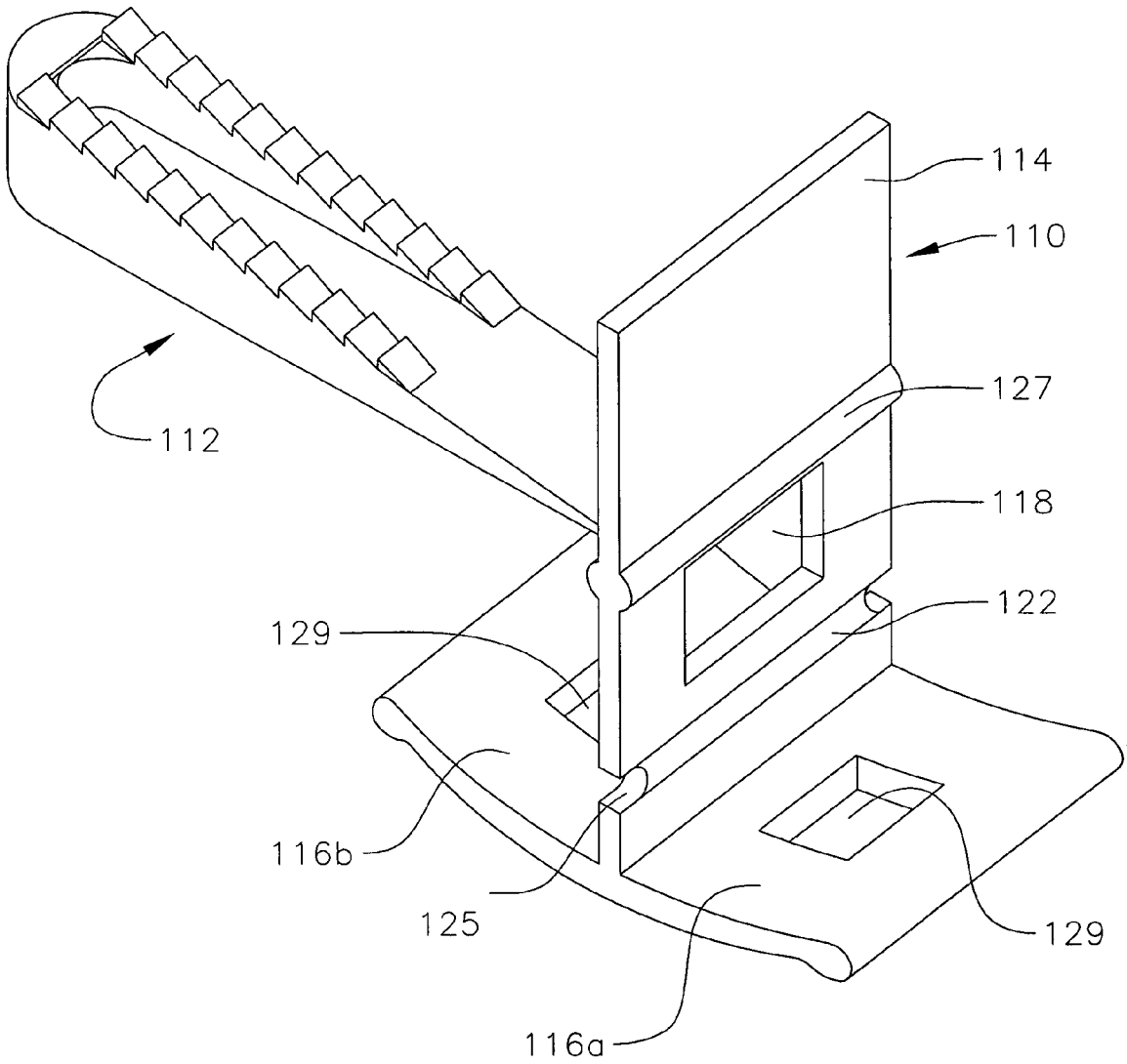
FIG. 8 is a perspective view of an exemplary embodiment leveling device with a wedge of the present invention.
Figure 9:
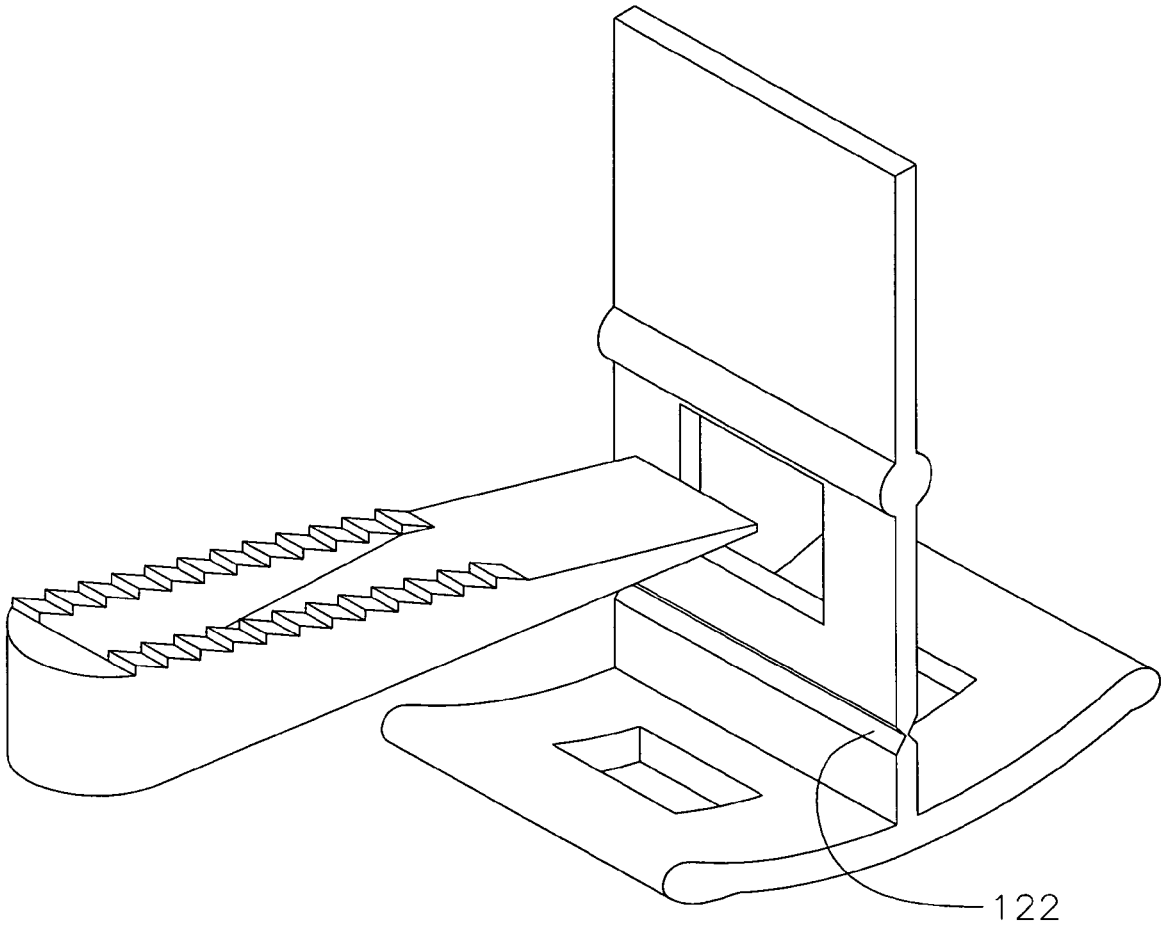
FIG. 9 is a perspective view of yet a further exemplary embodiment leveling and spacing device with a wedge of the present invention.

An inventive leveling and spacing device 110 is provided. The inventive device includes a first member 114 and a transverse member 116 which includes a section 116*a* on one side of the first member and a second section 116*b* on the other side of the first main member as for example shown in FIG. 6. Each section 116*a*, 116*b* in an exemplary embodiment shown in FIG. 6 is curved or has at least a portion which curves so as to define a convex curvature 117 on a distal surface or lower surface of the transverse member 116. An opening 118 is formed on the first member to accommodate a wedge 112. A breakaway section or line 122 is formed on the first member and is spaced such that it will extend into the thickness of the tiles 134*a*, 134*b* when installed, as for example shown in FIG. 6. To achieve this, the breakaway line is located at or above the highest points of the horizontal member sections 116*a*, 116*b*. In this regard, when the tiles rest on such points, the breakaway line is at or located above the lower surface of such tiles and when the wedge is installed through opening 118 and presses the tiles against the transverse member sections 116*a* and 116*b* causing these sections to compress (and flatten if they include a curved portion) toward the subsurface on which such tiles are installed, such that the breakaway line is located at a height within the thickness of the installed tiles. Consequently, the breakaway line is not exposed to the adhesive 132 which is used to adhere the tiles to a floor or subsurface 130. In this regard, the breakaway line allows for a consistently clean breakaway of the first main member from the transverse member. Furthermore, to help the breakaway of the first main member from the transverse member, the breakaway line may be formed by two opposing V-shaped or U-shaped notches 123 extending from opposite surfaces of the vertical member 114, as for example shown in FIG. 7. In another exemplary embodiment, the breakaway line is formed by a reduction in the thickness of the material. Moreover, a portion of the breakaway line or the material defining a breakaway line at the edges of the vertical member may be removed, defining cutouts 125, as for example shown in FIG. 8. This also helps with the breakaway of the first main member from the transverse member. In another exemplary embodiment, the breakaway line 122 may extend all the way to the edges of the vertical member, as for example shown in FIG. 9.

"Breakaway line" or "breakaway section" as used herein refers to a section of reduced thickness that would promote the breakaway and thus, the separation of such section.

In addition, a stiffener portion 127 may be formed at the upper edge of the opening 118 which accommodates the wedge 112, bolstering such edge. In this regard, as the wedge is inserted into the opening, it does not crush the upper edge of the opening. Furthermore, at least one opening 129 is formed through each section 116*a*, 116*b* of the transverse member 116 on either side of the first main member 114. In another exemplary embodiment, multiple openings may be formed through each section of the transverse member. These openings allow for the adhesive 132 to penetrate the opening and extend over the surface of the transverse member sections 116*a*, 116*b*, as for example shown in FIG.6. In this regard, the transverse member sections adhere to the subsurface or floor and the tiles get adhered to the transverse member. Consequently, the tile end portions 131*a*, 131*b* which extend over the transverse member sections 116*a*, 116*b*, respectively get proper support, thereby reducing the risk of cracking, crumbling and separating from the subsurface.

In an exemplary embodiment, an upper surface 126 of the wedge 112 is tapered downwards and includes teeth 150. Each of these teeth is defined by a vertical surface 152 or riser and an obliquely extending surface 154 from the top of the vertical surface 152 in the same general direction as the upper surface 126 of the wedge. In this regard, these teeth latch on to the upper edge of the opening when the wedge is inserted into the opening 118, thereby preventing the wedge from inadvertently slipping out of the opening 118.

In the exemplary embodiment shown, a center portion of the wedge is hollow, defining two opposing edges. The teeth are formed on these opposing edges.

In an exemplary embodiment, adhesive is applied to the subsurface of where tiles are to be adhered and is also applied to the undersurface of a first tile. As the tile is being placed on the subsurface with the adhesive, an exemplary embodiment leveling and spacing device is positioned such that the tile undersurface sits on top of the transverse member section 116*a* and it abuts the device first main member 114. The device is positioned on the subsurface such that both transverse member sections sit on the adhesive applied to the subsurface. Adhesive is applied on the undersurface of a second tile. Adhesive may also be further applied to the subsurface if necessary. The second tile is laid on the subsurface such that the second tile undersurface sits on top of the second transverse member section 116*b* and also abuts the first main member 114. The wedge is then fitted through the opening 118. As the wedge wedges itself in the opening it applies pressure on the upper surfaces of the tiles leveling such tiles relative to each other. The pressure causes the adhesive to travel through the openings formed on the transverse member sections ensuring that the adhesive is spread on the top and bottom and through each of the transverse member sections. It should be understood that if the tiles are being installed so that they are adjacent to more than one other tile, than a leveling device should be placed along each side of a tile that will be adjacent to another tile. For example, if a first tile is going to be surrounded by four other tiles, than a leveling device must be placed adjacent each side of the first tile such that a transverse member section of each device is sandwiched between the first tile and the subsurface.

Once the adhesive cures, the vertical member may be removed by "kicking it" off or by pushing it sideways or pulling it off. Since the breakaway lines on the exemplary devices are positioned such that they are within the tile thickness of the tile and away from the adhesive, the vertical sections should consistently break off when subjected to the same force. In an exemplary embodiment, wedges may be used having a sufficient thickness such that when they are pushed beyond a certain point through the opening of the vertical member, they will apply a sufficient force to break the vertical member along the breakaway line. In such an embodiment, the vertical member may be removed by further pushing the wedge through the vertical member opening.

Although the present invention has been described and illustrated to respect to exemplary embodiments, it is to be understood that it is not to be so limited, since changes and modifications may be made therein which are within the full intended scope of this invention as hereinafter claimed.

The invention claimed is:

1. A tile leveling device and tile combination comprising:
a device comprising,
a main member,
a first section extending transversely from said main member,
a second section extending transversely from said main member in a direction opposite said first section,
an enclosed opening formed through said main member,
a breakaway section defined along said main member;
a first tile over the first section, said first tile having a first surface opposite a second surface, wherein the first surface faces the first section and the second surface is farther from the first section than the first surface;
a second tile over the second section, said second tile having a first surface opposite a second surface, wherein the second tile first surface faces the second section and the second tile second surface is farther from the second section than the second tile first surface; and
a member having a tapered surface penetrating said opening and exerting a force against both tiles pressing said tiles against said first and second sections, wherein said breakaway section is located beyond the first surface of each of said first and second tiles in a direction away from said first and second sections.

2. The combination as recited in claim 1 wherein an opening is formed through the first section for allowing an adhesive to flow there through.

3. The combination as recited in claim 2 wherein an opening is formed through the second section for allowing an adhesive to flow there through.

4. The combination as recited in claim 1 wherein the opening formed through the main member comprises a first edge opposite a second edge, wherein the first edge is further from the first and second sections than the second edge and wherein a stiffener portion is formed proximate the first edge for bolstering said first edge.

5. The combination as recited in claim 1 wherein the main member comprises a first notch extending from a first edge of the main member and a second notch extending from a second edge of the main member, wherein said breakaway section extends from the first notch to the second notch.

6. The combination as recited in claim 1 wherein each of said first and second sections have at least a curved portion having a curvature when viewed in cross-section, wherein said force causes said curvature to reduce.

7. The combination as recited in claim 1 wherein said breakaway section is located between the first and second surfaces of each of said first and second tiles.

8. The combination as recited in claim 1 wherein the member penetrating said opening is a wedge.

9. A tile leveling device and tile combination comprising:
a first tile having a first surface opposite a second surface;
a second tile having a first surface opposite a second surface; and
a device comprising,
a main member,
a first section extending transversely from said main member, wherein the first tile is over said first section,
a second section extending transversely from said main member in a direction opposite said first section, wherein the second tile is over the second section,
an enclosed opening formed through said main member,
a member having a tapered surface penetrating said opening and exerting a force against both tiles pressing said tiles against said first and second sections, and
a breakaway section defined along said main member, said breakaway section being located between the first and second surfaces of each of said first and second tiles, wherein the opening formed through the main member comprises a first edge opposite a second edge, wherein the first edge is further from the first and second sections than the second edge and wherein a stiffener portion is formed proximate the first edge for bolstering said first edge.

10. The combination as recited in claim 9 wherein the member penetrating said opening is a wedge.

* * * * *

UNITED STATES PATENT AND TRADEMARK OFFICE

CERTIFICATE OF CORRECTION

PATENT NO. : 7,992,354 B2
APPLICATION NO. : 12/079175
DATED : August 9, 2011
INVENTOR(S) : Robert C. Doda, Jr.

It is certified that error appears in the above-identified patent and that said Letters Patent is hereby corrected as shown below:

In the Claims

Column 5, Claim 1, line 47 Delete "member," Insert -- member, and --

Signed and Sealed this
Twenty-seventh Day of March, 2012

David J. Kappos

David J. Kappos
*Director of the United States Patent and Trademark Office*